United States Patent [19]

Best, Jr.

[11] Patent Number: 4,715,568

[45] Date of Patent: Dec. 29, 1987

[54] EXPANSIBLE PITON

[75] Inventor: Donald D. Best, Jr., Escalon, Calif.

[73] Assignee: David A. Hornbeck, Reno, Nev. ; a part interest

[21] Appl. No.: 893,214

[22] Filed: Aug. 5, 1986

Related U.S. Application Data

[62] Division of Ser. No. 778,571, Sep. 20, 1985, abandoned.

[51] Int. Cl.[4] ..... A62B 29/08

[52] U.S. Cl. ..... 248/1; 248/200; 248/231.9

[58] Field of Search ..... 248/1, 200, 231.9, 231.2; 182/5, 6; 294/94, 96

[56] References Cited

U.S. PATENT DOCUMENTS 3,903,785 9/1975 Pepper, Jr. ..... 248/1
4,572,464 2/1986 Phillips ..... 248/1

FOREIGN PATENT DOCUMENTS 0047232 3/1982 European Pat. Off. ..... 248/1
2440206 7/1980 France ..... 248/1
2153952 8/1985 United Kingdom ..... 182/5

*Primary Examiner*—Ramon S. Britts
*Assistant Examiner*—Karen J. Chotkowski
*Attorney, Agent, or Firm*—Lothrop & West

[57] ABSTRACT

A wedge plate has a substantially planar, rock-engaging surface and a friction surface converging with the rock-engaging surface at a non-overhauling angle to define a thick end portion of the wedge plate. A flexible tube or frame is secured to the thick end portion of the wedge plate and extends away therefrom. A body has a surface one portion of which is engageable with a rock surface and the other portion of which slidably engages the friction surface of the wedge plate. A flexible wire extends through or alongside the flexible tube or frame. The wire and tube or frame are severally connected to the wedge plate and to the body. Individual hand grips on the tube or frame and wire permit manual sliding of the wire in the tube or frame and corresponding sliding of the body and the wedge plate. A spring opposes such sliding in one direction. A climbing line connection is joined to the wire.

2 Claims, 20 Drawing Figures

EXPANSIBLE PITON

This is a divisional of application Ser. No. 778,571, filed Sept. 20, 1985, and now abandoned.

BRIEF SUMMARY OF THE INVENTION

For rock climbing, an adjustable piton for use in the narrow crevice of the rock has a wedge plate with a rock-engaging, substantially planar surface and a friction surface that is substantially planar and converges with the rock-engaging surface at a non-overhauling angle. A flexible tube or frame engages the thick end portion of the wedge plate and extends away from the crevice to carry a hand grip. A body has a surface, part of which is rock-engaging and part of which is slidably engageable with the friction surface of the wedge plate. One or more flexible wires engage the body and extend through the tube or alongside the frame and away from the crevice to carry a hand grip and to carry a climbing line. A spring engages the tube or frame and the wire and, unless manually overcome, urges the body to slide toward the thick end portion of the wedge plate. In one form of device, the body may be rotated manually or by rotation of the wires in the tube to present different friction surfaces of the body and the wedge plate.

PRIOR ART

There are numerous United States patents having to do with aids for assisting in mountaineering and especially rock climbing. They seem to fall into two principal categories. One category is represented by U.S. Pat. No. 3,877,679 issued Apr. 18, 1975 to Greg E. Lowe. This shows a sort of toggle arrangement which opens against opposite walls of a crevice and sustains a load. The other category is represented by U.S. Pat. No. 4,082,241 issued Apr. 4, 1978 to John Brent Burkey and shows a solid chock or block which is generally of a triangular cross-section, sustains a climbing rope, and wedges into a crevice in the rock.

Both of the foregoing categories are distinct from the disclosure herein in that they are both devoid of any manually adjustable or expansible means for setting or pre-setting a device to the particular crevice in which it is employed.

BRIEF DESCRIPTION OF THE SEVERAL VIEWS OF THE DRAWINGS i

DETAILED DESCRIPTION

Figure 1:
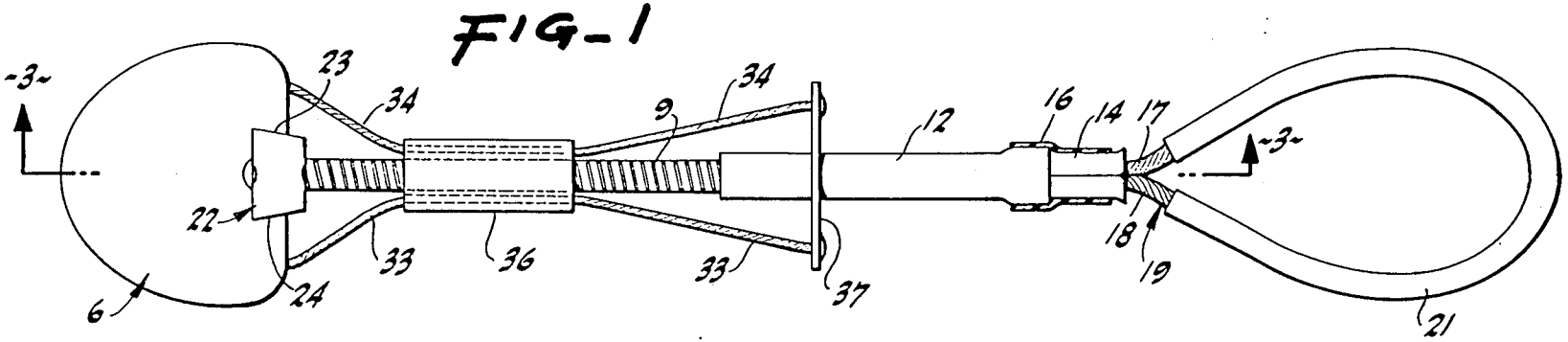
FIG. 1 is a plan of one form of expansible piton constructed pursuant to the invention.

In one form of the invention, as shown in FIGS. 1 through 8, inclusive, there is provided a primary plate 6 conveniently fabricated of any reasonably stiff material and having a lower planar surface 7 and an upper planar surface 8. The surfaces 7 and 8 converge at a non-overhauling angle toward one end of the plate so that the plate is approximately triangular in side elevation. In plan, the plate is conveniently semi-circular, approximately, and the surfaces 7 and 8 may be of relatively deformable material such as lead, so that they can momentarily partake of the configuration of rock against which they abut.

From the thick end of the plate 6 there extends a flexible tube 9 or frame conveniently related to the plate 6 through a flexible cable 11 so that there is ready orientation of the plate 6 with respect to the cable at different angles, both vertically and transversely. The flexible tube 9 or frame proceeds into and is slidably joined to a stiff tube 12 also acting as a frame and affording a shoulder 13 at their juncture. The stiff tube 12 carries an end sleeve 14 having a protector 16. The sleeve 14 is secured to or provides an anchor for the adjacent ends 17 and 18 of a loop 19 protected by a cover 21 and serving as an appropriate hand-hold and anchor.

Designed to abut the inclined surface 8 of the plate 6 as well as to abut a rock face is a body 22 that is preferably generally stiff but can be of a slightly deformable material. The body 22 is generally circular-cylindrical in configuration intermediate its ends and has a pair of beveled flat surfaces 23 and 24 at its ends. The body is mounted at the end of a flexible wire 26. There is a firm fastening 27 of the wire 26 to the body 22.

The plate 6 and the body 22 are movably related in that from the thick end of the plate extend cables 33 and 34 carried lightly through a sleeve 36 and joined to a hand grip plate 37 mounted to move along the tube 12.

A spring 38 has one end abutting the shoulder 13 at the end of the tube 9 and has its other end abutting the face of the sleeve 14 fast in the end of the stiff tube 12. The spring tends to urge the wire 26 and the tube 9 to move axially with respect to each other in a separating direction.

The inclination or included angle of the plate 6 is of a non-overhauling value; say, about 17 to 20 degrees, so that wedging is possible and the transverse load does not cause longitudinal, relative movement, but the longitudinal load causes increased transverse wedging or gripping.

Figure 2:
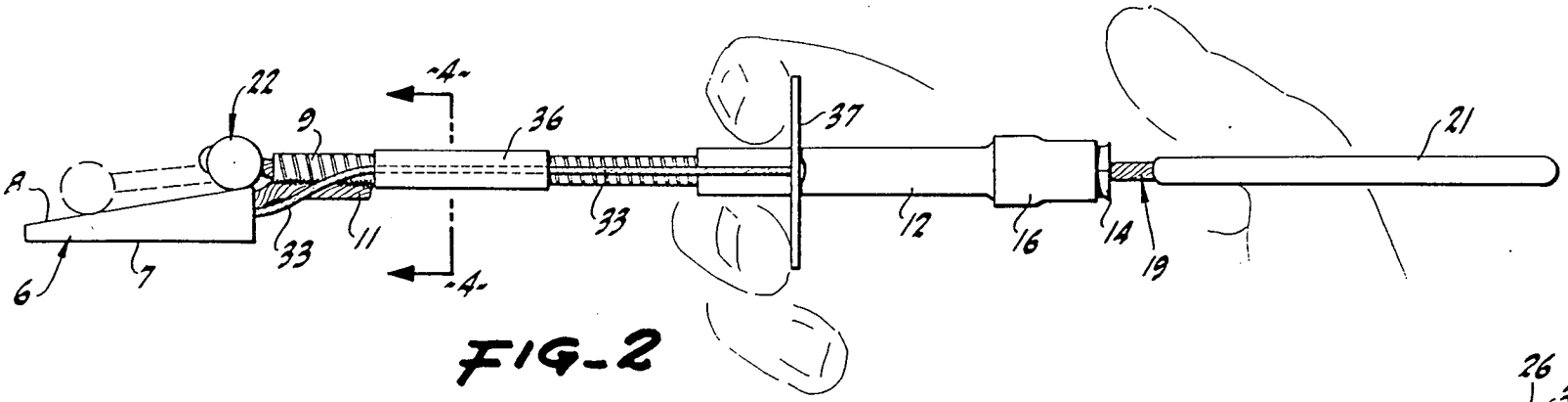
FIG. 2 is a side elevation of the piton of FIG. 1 showing its position in the hand of a user.
Figure 4:
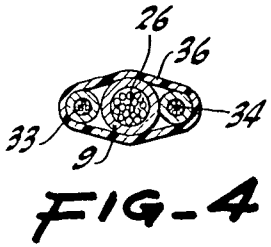
FIG. 4 is a cross-section, the plane of which is indicated by the line 4—4 of FIG. 2, certain portions being omitted.
Figure 3:
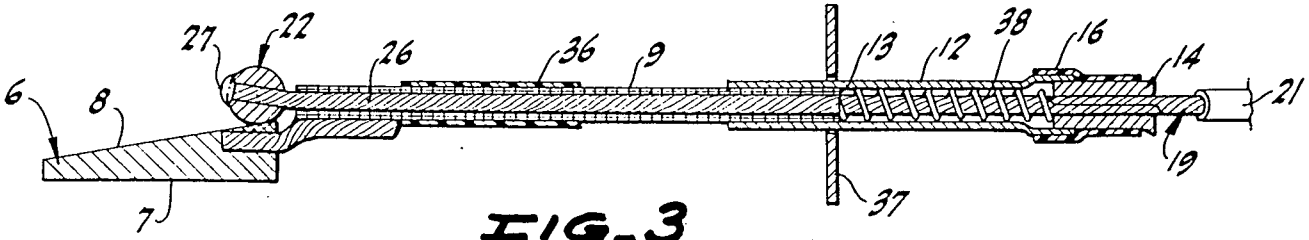
FIG. 3 is a cross-section, the plane of which is indicated by the line 3—3 of FIG. 1.

In the use of this device, the climber puts his fingers against the cross plate finger grip 37 and his thumb within the loop 19, as shown in FIG. 2, and by causing his thumb and fingers to approach each other slides the body 22 along the surface of the primary, friction plate 6 from the thick end toward the thin end thereof. By so doing, he causes the overall transverse thickness of the end of the device to vary from a relatively small dimension when the body 22 is on the thin portion of the plate 6 to a much larger dimension when the body is on the thicker end of the plate 6.

Figure 5:
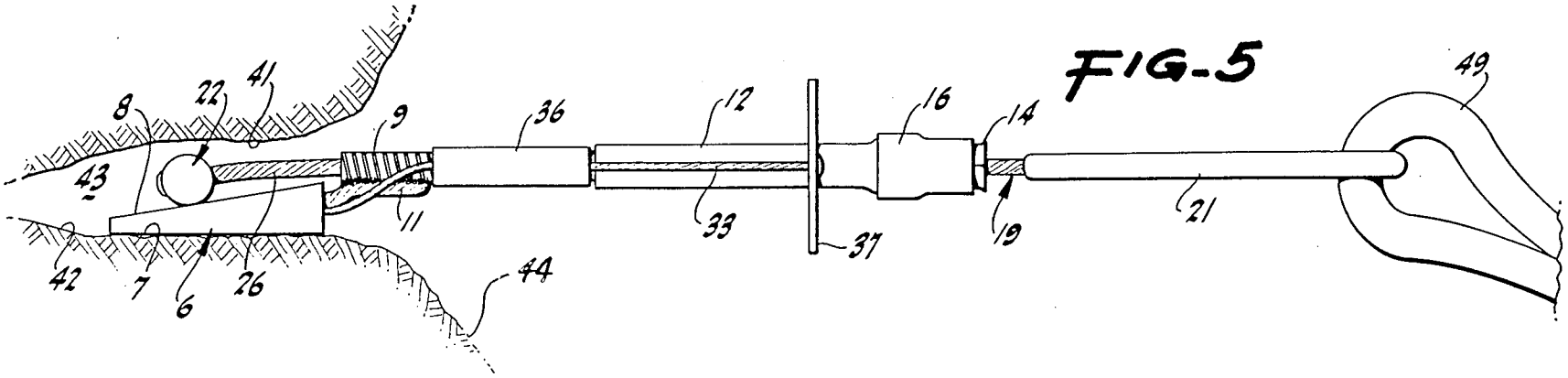
FIG. 5 is a view like FIG. 2 but showing the expansible piton in position in a crevice in a rock wall and with a line attached and ready to assume a load.
Figure 6:
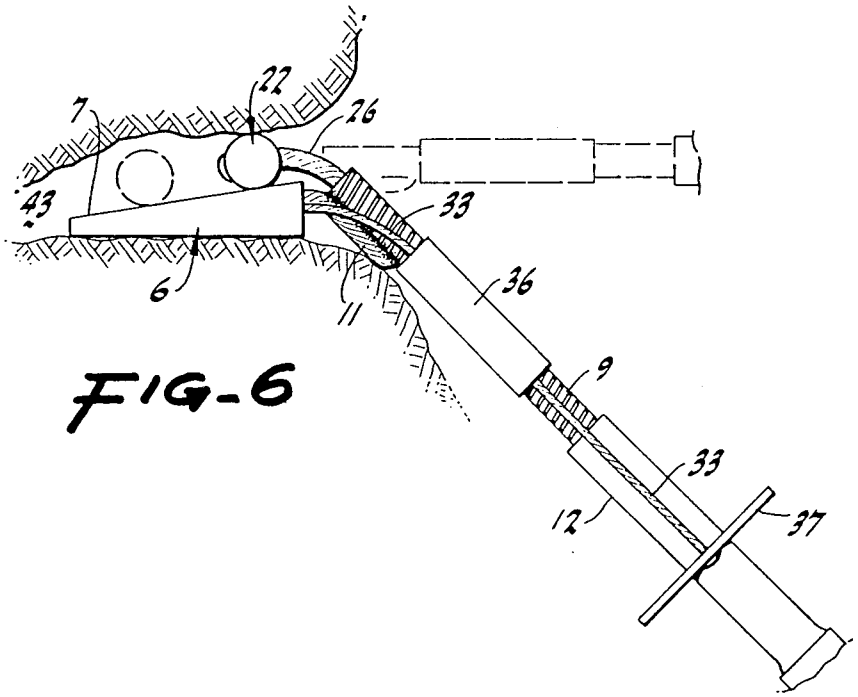
FIG. 6 is a view comparable to FIG. 5 but showing the expansible piton in fixed position in the crevice and with a load imposed thereon.

As shown particularly in FIGS. 5 and 6, this maneuverability is useful in initially inserting and then frictionally engaging the piton with the walls 41 and 42 of a crevice 43 in a rock wall 44. By causing the body 22 to move toward the thin end of the wedge plate, and thus reducing the overall vertical dimension or transverse dimension of the parts, the wedge and the body simultaneously can be easily thrust into the crevice 43 by manipulation of their supporting and connected parts. Once the parts are in position in the crevice, the user by relaxing his hand permits the spring 38 to urge the body from the thin portion of the plate to the thick portion thereof. This motion is illustrated in the different dimensions and positions shown in FIGS. 5 and 6. In the thicker position of the structure, both walls 41 and 42 of the crevice are engaged. Any outward load transmitted to the engaging members 6 and 22 through their connections tends to jam the body even more tightly against the triangular, friction plate and so affords additional load carrying capacity. On the other hand, when the user desires to disengage the adjustable piton, he again squeezes the loop 19 and the plate 37 toward each other. The body 22 then descends the inclined ramp of the wedge plate and disengages from the side wall 41 of the crevice, thus permitting the piton to be easily withdrawn in its collapsed condition.

Since the parts are flexible and can be operated from nearly any position or any angle with respect to the crevice, it is easily arranged for a suitable load bearing, wall contact to be accomplished.

Figure 8:
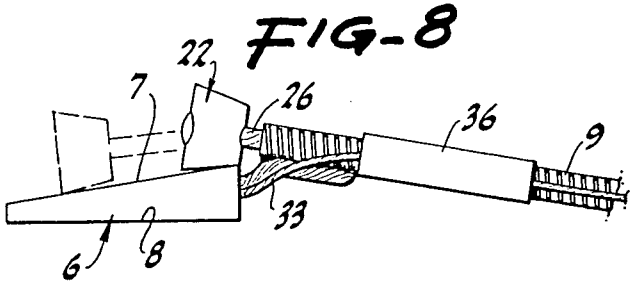
FIG. 8 is a side elevation of the structure of FIG. 7, portions being broken away.
Figure 7:
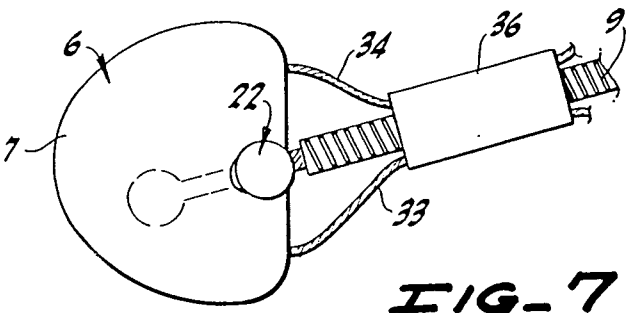
FIG. 7 is a plan of the arrangement of the preceding figures but with the load bearing body in an alternate position.

In some cases, the crevice may be substantially different in transverse dimension. Under those circumstances, as shown in FIGS. 7 and 8, the user by holding the tube 9 and sleeve 36 and by rotating the loop 19 about the longitudinal axis of the tubes 9 and 12 can rotate the cable 26 and can also rotate the body 22 so that one of its inclined surfaces or ends 23 or 24 abuts the wedge plate 6. This affords a different range of dimensional engagement with the walls of the crevice. The user, by employing only one hand, can adjust the piton for either of two ranges of operation and can within each of those ranges move the body 22 along the inclined plate 6 so as frictionally to engage the opposite side walls of the crevice for load bearing purposes. The load itself is transmitted by a line 49 (FIG. 5) engaged with the loop 19 and can readily be removed therefrom when the piton is to be separately handled.

Figure 9:
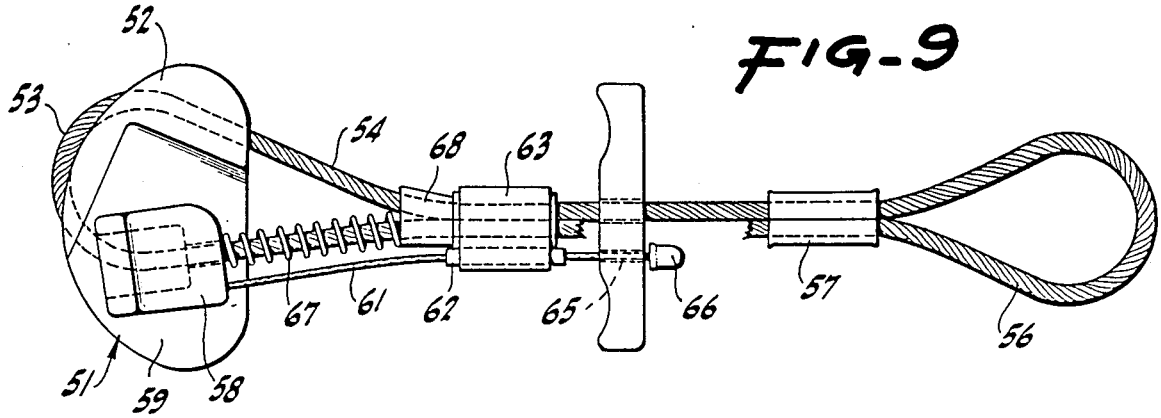
FIG. 9 is a plan view of an alternate form of expansible piton.
Figure 10:
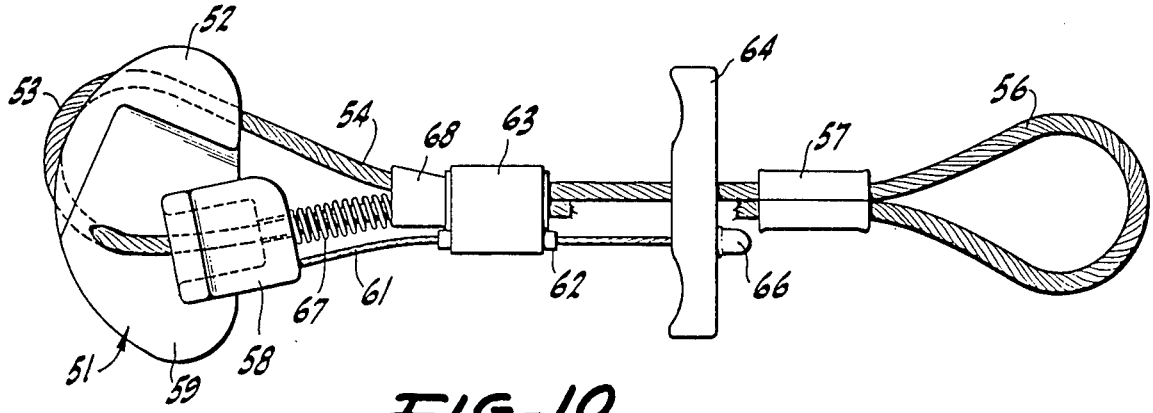
FIG. 10 is a view comparable to FIG. 9 but showing the parts in a different position.
Figure 11:
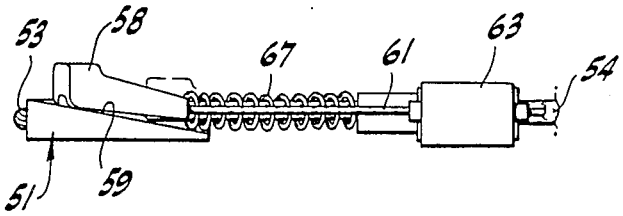
FIG. 11 is a side elevation of the structure in position as shown in FIG. 9 with parts being broken away.
Figure 12:
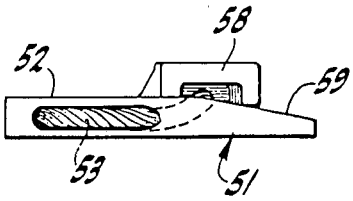
FIG. 12 is an end elevation of the structure shown in FIG. 11 with parts broken away.
Figure 13:
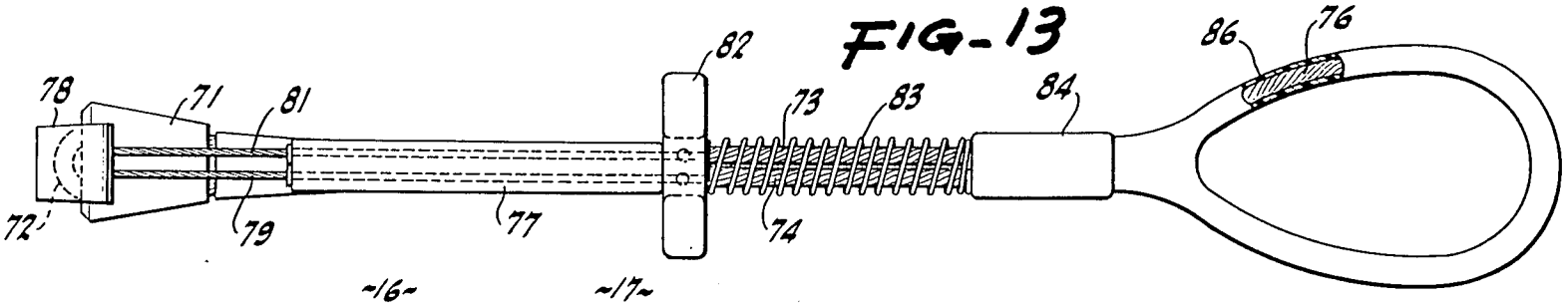
FIG. 13 is a plan view of a modified form of piton.
Figure 14:
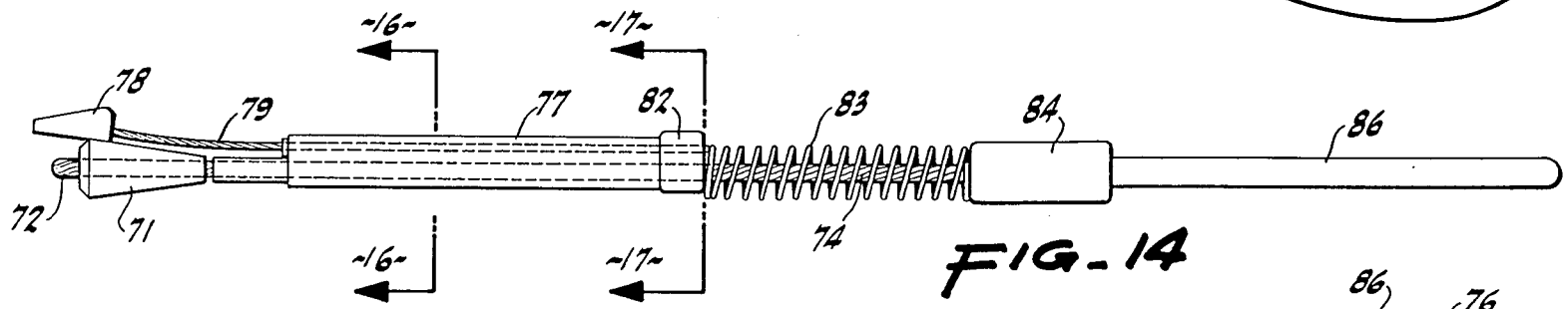
FIG. 14 is a side elevation of the structure of FIG. 13.

A related version of the structure is shown in FIGS. 9, 10 and 11. In this modified form of the device there is a wedge plate 51 having its thicker end 52 away from the user. This thicker end carries embedded firmly in it the looped end 53 of a cable 54 or frame that extends away from the plate and at its opposite end is formed into another loop 56 held by a clip 57 and effective to receive a line, such as the line 49.

A body 58 abuts and is slidable on the inclined face 59 of the wedge, being manually impelled by a wire 61 anchored in the body 58. The wire 61 extends through a guide 62 held in a clip 63 surrounding the cable 54 or frame and is maneuvered by a transverse hand grip 64 slidable on the cable 54 and has an opening 65 (FIG. 9) through which the wire 61 extends to a stop 66. A coil spring 67 is interposed between one end of the body 58 and a guide 68 on or abutting the clip 63.

In this embodiment the spring 67 urges the body 58 to slide on the inclined surface toward the thicker portion of the wedge member and tends to move the hand piece 64 to the left in FIG. 10. The body 58 continues into an extreme position substantially as shown in FIG. 9. When the user puts his thumb through the loop 56 and puts a couple of fingers on the cross bar 64 and contracts his hand, that puts tension through the wire 61 on the body 58 and moves the body to occupy a position (FIG. 10) on the wedge member 59 so that the overall height of the assembly is reduced. When it is thus made thinner, the body and wedge can be positioned inside a crevice. Then, when the finger pressure is removed from the cross bar 64, the spring 67 urges the parts to engage and press against the opposite walls of the crevice and afford a firm, transverse interengagement to withstand loads imposed by a line on the loop 56. In this instance also, the user by employing but one hand can manipulate the adjustable piton so that it can readily be reduced in thickness for introduction into a crevice, and by releasing his hand-hold the user can permit the spring to enlarge the transverse dimension of the members and so afford a firm frictional grip with the side walls of the crevice.

In a modified form of structure shown in FIGS. 13 through 17, the arrangement includes a primary plate 71 having dihedral wedge surfaces, as before, and engaged firmly with a looped cable 72 having runs 73 and 74 also defining a hand loop 76. The cable runs 73 and 74 are in part positioned closely together within a sleeve 77 that is axially stationary thereon. Slidably movable over a surface of the plate 71 is a wedge body 78 anchored to the ends of a pair of operating cables 79 and 81 that extend alongside the runs 73 and 74 and go through an adjacent part of the sleeve 77. Both the cables 79 and 81 are fastened to a rocker 82 extending transversely of the sleeve 77 far enough for finger engagement by the user and freely slidable along the cables 73 and 74.

A coil spring 83 surrounds the runs 73 and 74 and at one end abuts the rocker 82 and at the other end abuts a cuff 84 secured stationarily to the merged end of a cover 86 around the hand loop 76.

With this device, the user puts his thumb through the loop 76 and engages adjacent fingers against the far surfaces of the rocker 82. When he moves his thumb and fingers to approach each other evenly, he moves the rocker 82 toward the loop 76 and exerts a compression force on the spring 83 while linearly moving the body 78 across the plate 71 to reduce their overall vertical dimension. When he relaxes his grip, the user permits the spring 83 to urge the body 78 up the ramp of the plate 71 and increases their combined vertical dimension, thus effectuating an anchor.

Figure 15:
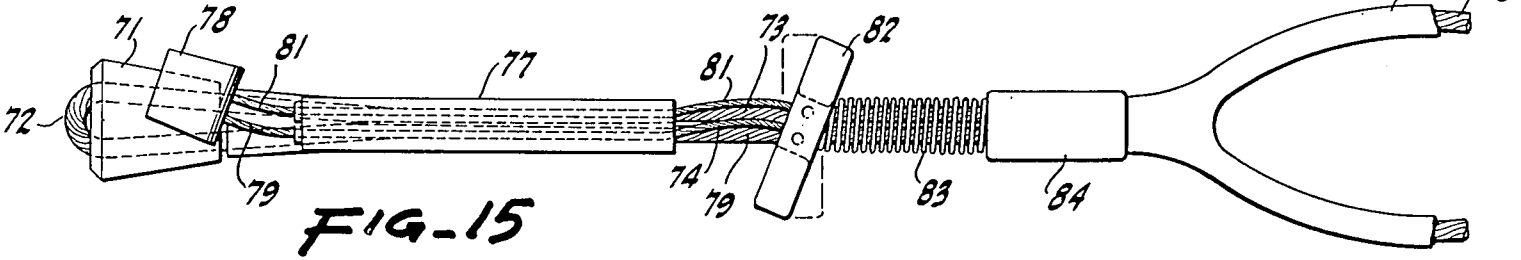
FIG. 15 is a view like FIG. 13 and showing the parts in a specially actuated position.
Figure 17:
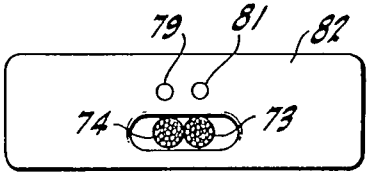
FIG. 17 is a cross-section, the plane of which is indicated by the line 17—17 of FIG. 14.
Figure 16:
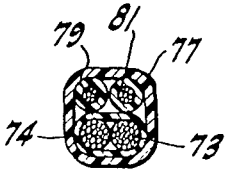
FIG. 16 is a cross-section, the plane of section being indicated by the line 16—16 of FIG. 14.

Because of the dual operating cables 79 and 81, the user instead of simply pulling evenly on the rocker 82 can pull harder on one side than the other. This rotates the rocker, as shown in FIG. 15, and through the dual operating cables 79 and 81 similarly rotates the body 78, thus affording an additional motion for adjusting the combined effect of the plate 71 and the body 78.

Figure 18:
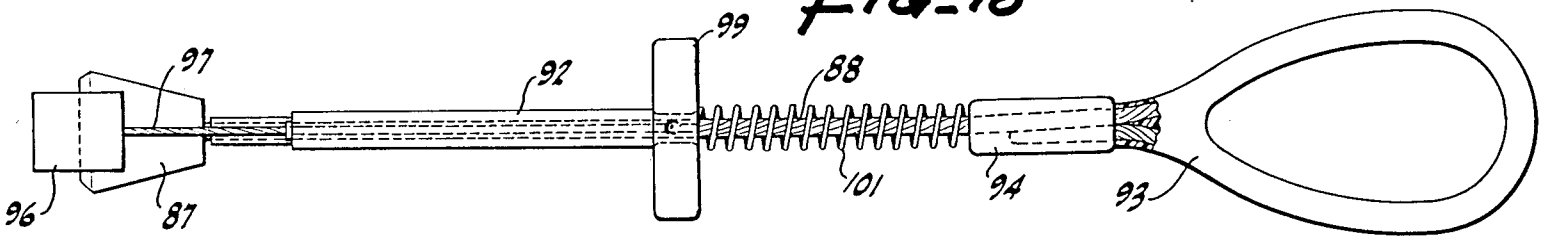
FIG. 18 is a plan view of a still further modified form of the piton.
Figure 19:
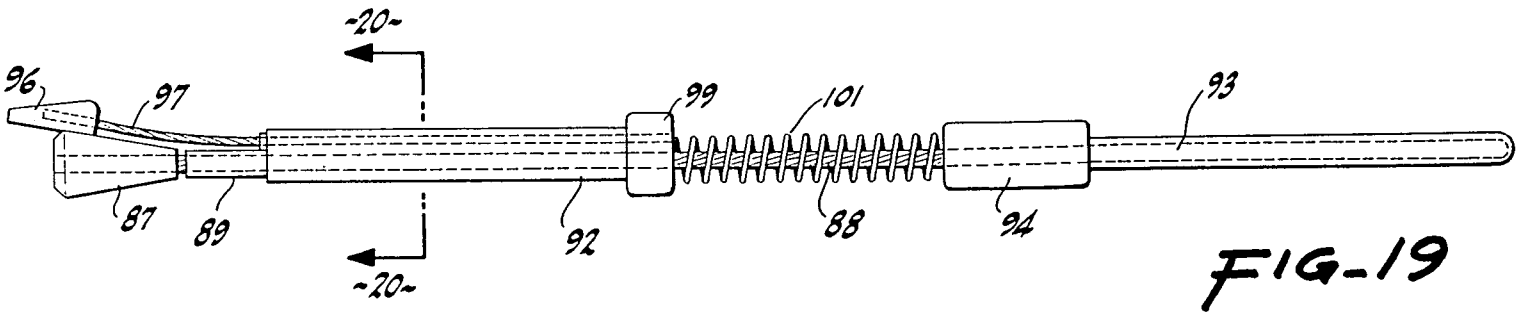
FIG. 19 is a side elevation of the structure of FIG. 18.
Figure 20:
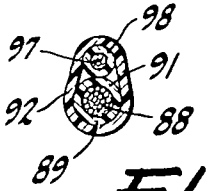
FIG. 20 is a cross-section, the plane of which is indicated by line 20—20 of FIG. 18.

In a simplified form of device, as shown in FIGS. 18–20, there is a primary plate 87 of the same nature as the previously described primary plates. A heavy cable 88 extends from anchorage in that plate 87 through a sleeve 89 and a cover 91 as well as a flexible cover 92. The remote portion of the cable 88 is formed into a loop 93 secured by a clip 94.

Slidable on the plate 87 is a wedge body 96 to which is anchored a single control cable 97. This parallels the cable 88 and extends through a guide 98 in the cover 92 to terminate fixedly in a cross bar 99 that is perforated to encompass and slide on the heavy cable 88. A spring 101 between the clip 94 and the cross bar 99 urges the parts into relaxed positions.

In the use of this device, the user puts his thumb through the loop 93 and puts two adjacent fingers against the far side of the cross bar 99 on opposite sides of the cable 88. By appropriately pulling the cross bar against the force of the spring, he maneuvers the body 96 back and forth on the plate 87 to provide an appropriate gripping or anchoring position.

I claim:

1. An expansible piton for use in a rock crevice comprising:

a. a primary plate having a first rock-contacting surface;

b. positioning means extending along a longitudinal axis and attached to said primary plate for moving said primary plate from a distant location with said first rock-contacting surface against one side of the crevice, said positioning means including a hand loop, a cable extending along said longitudinal axis, said cable being attached at one end to said primary plate and at the other end to said hand loop, and a sleeve on said axis of said cable intermediate said primary plate and said hand loop;

c. a secondary body having a second rock-contacting surface, said primary plate and said secondary body being further defined therebetween by a wedge surface and an abutting surface disposed slidably to contact said wedge surface, said wedge surface and said abutting surface being disposed between said first and second rock-contacting surfaces;

d. moving means attached to said secondary body for selectively moving said secondary body in a direction parallel to said longitudinal axis and in a direction transverse thereto, said moving means including a rocker slidable on said cable between said sleeve and said hand loop, said rocker being initially oriented transversely relative to said longitudinal axis, and a pair of operating cables translatably extending through said sleeve from said rocker to said secondary body in a direction initially parallel to said longitudinal axis, said cables being spaced apart to provide a moment arm capable of rotating said secondary body in respons to rotation of said rocker.

2. An expansible piton as in claim 1 including spring means interposed between said hand loop and said rocker for biasing said rocker toward said sleeve and into said initially transverse orientation.

* * * * *